US008022283B1

(12) United States Patent
Williams, Jr.

(10) Patent No.: US 8,022,283 B1
(45) Date of Patent: Sep. 20, 2011

(54) ANTHROPOMETRIC SCAFFOLD FOR KEYBOARD-CONTROL PEDAL

(76) Inventor: John Williams, Jr., Austin, TX (US)

( * ) Notice: Subject to any disclaimer, the term of this patent is extended or adjusted under 35 U.S.C. 154(b) by 0 days.

(21) Appl. No.: 12/661,069

(22) Filed: Mar. 10, 2010

Related U.S. Application Data

(60) Provisional application No. 61/209,721, filed on Mar. 10, 2009.

(51) Int. Cl.
*G10D 13/02* (2006.01)

(52) U.S. Cl. ..... 84/423 R

(58) Field of Classification Search ..... 84/423 R, 84/426, 453
See application file for complete search history.

(56) References Cited

FOREIGN PATENT DOCUMENTS

TW 365384 U * 9/2009 ..... 84/453

OTHER PUBLICATIONS

Web-page display, printed Mar. 9, 2010 :URL [www.amazon.com ] showing oblique photo of Yamaha FC4 Piano-Style Foot Pedal and giving some data.

Web-page display printed Mar. 9, 2010 :URL [www.bbphotovideo.com ] showing oblique photo of Yamaha FC7 Volume Control Foot Pedal and giving some data.

Web-page display printed Jan. 5, 2008 : URL[www.creepnomore.com ] showing oblique photo of human foot w. shoe and sock being applied to typical keyboard foot pedal laid on surface of Creepnomore (R) device. The Creepnomore illustrated is apparently unrolled and laid on a flat, smooth, bare floor under the pedal. Creepnomore is manufactured by Spain Mfg. Co of Watervliet, NY 12189.

* cited by examiner

*Primary Examiner* — Kimberly Lockett
(74) *Attorney, Agent, or Firm* — M. Conrad Huffstutler, Jr.

(57) ABSTRACT

A scaffold for ergonomic positioning and reliable support of foot-control pedals of musical instruments is disclosed. The scaffold includes a three-walled channel for engaging the distal portion of the base of typical known keyboard control pedals. The scaffold is securely positioned for optimal foot access on the floor by means of a fixation socket which is engages an adjacent floor tube of a typical stand. The foot-pedal channel is adapted to engage the typical pedal base by friction and interference clamping to support its active elements at an ergonomic height and angular orientation during an energetic live performance with the keyboard player sitting and standing during different portions.

13 Claims, 3 Drawing Sheets

ANTHROPOMETRIC SCAFFOLD FOR KEYBOARD-CONTROL PEDAL

RELATED APPLICATION

This application claims the priority of U.S. Provisional Application 61/209,721, filed Mar. 10, 2009 which is included herein by reference.

FIELD OF THE INVENTION

This invention involves an advanced, ergonomic accessory used by keyboard musicians. The foot-control scaffold of the present invention provides electronic keyboard players a way to position their foot controls at optimum height-levels, tilt-angles and locations for each particular performance. The fixed, optimal location of the pedal(s) is particularly important to support the player's style, i.e., posture (seated or standing), and dynamic changes in the positions of the feet and/or body during a performance.

BACKGROUND OF THE INVENTION AND INFORMATION DISCLOSURE

According to Wikipedia.com,

"Piano pedals are foot-operated levers at the base of a piano which change the instrument's sound in various ways. Modern pianos usually have three pedals, from left to right, the soft pedal (or una corda), the sostenuto pedal, and the sustaining pedal (or damper pedal). Some pianos omit the sostenuto pedal, or have a middle pedal with a different purpose.

The development of the piano's pedals is an evolution that began from the very earliest days of the piano, and continued through the late nineteenth century. Throughout the years, the piano had as few as one modifying stop, and as many as six or more, before finally arriving at its current configuration of three.

The location of pedals on pianos through history. The location of foot pedals on the piano was another aspect of pedal development that fluctuated greatly during the evolution of the instrument. Piano builders were quite creative with their pedal placement on pianos, which sometimes gave the instruments a comical look, compared to what we are used to seeing today. The oldest surviving English grand, built by Backers in 1772, and many Broadwood grands had two foot pedals, una corda and damper, which were attached to the legs on the left and right of the keyboard. James Parakilas describes this pedal location as giving the piano a "pigeon-toed look", for they turned in slightly.

A table piano built by Jean-Henri Pape in the mid-nineteenth century had pedals on the two front legs of the piano, but unlike those on the Backers and Broadwood, these pedals faced straight in towards each other rather than out. A truly unique design is demonstrated in the "Dog Kennel" piano. It was built by Sebastien Mercer in 1831, and was nicknamed the "Dog Kennel" piano because of its shape.

Under the upright piano where the modem pedals would be located is a semi-circular hollow space where the feet of the player could rest. The una cordo and damper pedals are located at the left and right of this space, and face straight in, like the table piano pedals. Eventually during the nineteenth century, pedals were attached to a frame located centrally underneath the piano, to strengthen and stabilize the mechanism. According to Parakilas, this framework on the grand piano "often took the symbolic shape and name of a lyre", and it still carries the name "pedal lyre" today."

A typical classical-piano foot pedal moves about 20-50 mm to full deflection and requires a downward force of only a few Newtons for full manual-mechanical actuation of the coupled mechanisms relative to the vibrating strings of the instrument. In contrast, electronic keyboards generate sound from mathematical waveforms being applied to a set of speakers. The volume-control foot-pedal of such units does not modify any speaker mechanical characteristic but simply modulates the voltage or current being applied to the coil which drives the moving elements of the speaker. Therefore, the volume or waveform-modification foot pedals of an electronic keyboard are basically signal-control devices which facilitate the player's precise dynamic control of the acoustic tonal qualities of the notes/chords being played. Similarly, optimization of foot-control placement for precise operations requires a completely different design compared to a drum-beater (power) pedal for bass drums. Many of the latter devices are basically a chain-linkage to a pivoting beater arm which strikes the drum head; the drummer provides all the impulse power needed to sound the drum by means of a robust manual pedal.

Typical known foot pedals now available for modern, electronic keyboard-type musical devices emulate the general form and orientation of the pedals used on classic piano-type instruments. Harpsichords and clavichords were first offered with pedals starting in about 1709 by Bartolomeo Cristofori in Florence ITALY. The German pianoforte designers Silbermann and Stein both introduced versions of foot pedals to raise the string dampers over the period 1726 to about 1789; these devices accomplish the function of the "sustain" pedal of modern instruments. Together, the famous 1673 paintings of Johannes Vermeer, "A Lady Standing at a Virginal" and "A Lady Seated at a Virginal" suggest that neither sitting or standing player postures are new ideas and that standing players are not solely related to electronic-keyboard-type instruments.

Modern electronic keyboards are provided with about 10 different basic foldable stand configurations including: V-form, T-form, X-form, Z-form and conventional table-type. Some performers utilize two keyboards at the same time and several commercial stands will support two units, one above the other in a staggered array, analogous to 2-manual-organ. Generally the floor-contacting elements of all stands are fabricated from round or square metal tubing; the outside dimension of these tubes, LS3, is about 20-50 mm, and provides a dependable fixation attachment for alternative scaffold embodiments of present invention. Dual-keyboard players particularly need to have optimal placement and secure orientation of multiple foot-pedal controls.

Some keyboard producers incorporate support structures for integration/attachment of a proprietary foot pedal in the classic centered location about 200 mm behind the front edge of the keyboard, which is within easy foot range by a seated adult player. Major-brand accessory foot pedals are offered in two different design styles: (a) classic (Steinweg grand) and (b) industrial (as might be found on a machine tool). Usually, a OEM or factory-designed "classic" foot pedal is a simple cantilevered pedal with a "classic-form" rounded tip; the usual height of the tip is about 75 mm above the floor surface, which is usually workable for an adult player seated on a conventional bench. Known classic-type foot pedals follow a traditional narrow-base design, about 60 mm wide. The typical height is in the range 40-60 mm and the typical base width is about 60-80 mm. One factory-brand "industrial" design is provided with linking plates which permit side-by-side coupling of multiple foot pedals. Such coupling results in a spacing of only a few millimeters between the actuators, and may require special foot-pedal technics by the player. This "industrial" model is also provided with mechanical screw-adjustments for optimization of pedal travel and its initial angle; the latter feature is desired by players who perform standing. Many "add on" volume-control foot pedals for electronic keyboards are fitted with a flexible, signal-type cable connection of about 2 meters length which facilitates a wide range of placement preferences.

The Yamaha FC-4 is an example of the classic form (LPB1 ~80 mm), which is well suited to players wearing dress shoes while the Yamaha FC-7 is an example of the "industrial" configuration (LPB1 ~116 mm) which may be more suitable for players with larger feet or wearers of bulky athletic or safety shoes. Regrettably, one can find no technical standards on foot pedals relating to: (a) the texture and coefficient of friction of the floor-contacting elements, (b) tip height of the pedal actuator or (c) the force required and travel distance for full depression of the pedal/actuator. Finally, there have been no anthropometric studies on design of tethered foot pedals for electronic keyboards.

There are two serious and inherent problems with known tethered pedals: (a) possibility of significant lateral displacement during a performance (with resulting stress and inconvenience to the player) and (b) possible unexpected overturning (possibly a catastrophic event during a performance) under changes of foot technique or player position. The present invention provides a reliable solution to positioning by mechanically and frictionally engaging the distal portion of the pedal base; in addition, it also provides a means of optimal anthropomorphic adjustment of the tilt angle of a "standard pedal" for enhancement of player control of actuations.

Some OEM and "add-on" foot pedals may include "non-slip rubber plates" on the floor-contact surfaces of the base; such "rubber" patches at each end of the pedal are about 1 mm thick and about 30 mm square. Although such patches, even if they are prepared from soft rubber having an optimized surface texture for the mass and the particular actuation-force level, may provide a small frictional engagement with smooth, slick floor surfaces, their frictional characteristics are seriously degraded upon exposure to ordinary dust and lint. In such instances, the player must compensate with a quick glance toward the pedal to confirm its location prior to every pedal actuation or use adhesive strips to make a temporary "pedal location setup" for the event duration. For better pedal-base fixation at a specific point on a carpeted floor, some players modify the pedal bottom by addition of "Velcro™" elements. Such alterations, however, usually render the pedal utterly unsuitable for secure placement hard or smooth floor surfaces and frequently introduce adverse functional factors, e.g., altered tip height and modified tip-contact angle (with the player's footwear).

The ergonomic scaffold of the present invention offers many functional advantages which have long been desired by several classes of players. The present scaffold is of particular value to the player who needs to position his pedal(s) securely at: (a) a unique height-optimal tilt angle and/or (b) a specific lateral position on the floor under the keyboard. Young or small-stature players are able to concentrate fully on performing the music score rather than continually overcoming the inherent design deficiencies of a typical, separate pedal not provided with any reliable position-fixation and tilt-adjusting means. Players with a limited range-of-motion in their ankle or knee joints are able to fix their pedal(s) at the optimum angle(s) and location(s) for their unique capabilities and somatotype and to depend that the pedal(s) will not be either accidentally displaced laterally or moved angularly and will also resist toppling. For a typical player and stand, the ideal foot-pedal positioning may depend upon a number of factors unique to the stage, the event and the number of other performing musicians in the group.

Careful searches of patent documents accessible in USPTO and WIPO have not revealed any invention similar to the present foot-pedal scaffold for musical instruments. For example, within the group of about 50 documents indexed as US Class 84/426, none relates to apparatus or methods of use which are even remotely similar in either form or function to the present invention.

SUMMARY OF THE INVENTION

The inventive concept of the present foot pedal scaffold is the integration of two opposing parallel side rails with an array of ullage elements and a keyboard-base-fixation element, the resulting unique system of technical features adapted to support one or more standard piano-type foot pedal(s) each at a particular angle re the floor surface and to stabilize both: (a) lateral position relative a selected point on the keyboard stand and (b) vertical position relative to tipping due to accidental oblique foot actions. The side rails provide alternative pedal-base channels (PBCs) which offer: (a) a fixed separation customized for particular pedal base, (b) a particular fixed separation larger than most standard pedals or (c) variable-adjustable separation, i.e., opposing rails are slideably connected with multiple transverse linkages long enough to accommodate one or two pedals, even ones with differing base widths. Ullage elements of variable thickness, shape, surface-friction/texture and elasticity are applied, using known methods including adhesive, hook-loop, ties, pins, etc., to the pedal-base-contacting surfaces for custom adjustment of: (a) the angle of the pedal base re the floor surface and (b) the degree of mechanical-frictional stabilization engagement of the side rails with the pedal base(s). Bottom and side wall ullage components may also be prepared with surface-texture patterns facing the channel interior, e.g., oriented, high-friction ribs or a pattern of random-sized, raised features. Some exemplary types of known ullage elastomers are listed in TABLES 2a and 2b. The mechanical properties of the illustrative solid elastomers listed can be significantly modified by foaming or expansion processes whereby a gas is generated by a chemical reaction or released by an array of fine nozzles into the elastomer compound in a liquid-fluid state. For example the density and modulus of a foamed elastomer compound can be reduced to values lower than 10% of the comparable value for the solid material. Ullage elements of the present invention are prepared by forming selected elastic materials/foams into predetermined shapes and surface textures adapted for reliable, temporary mechanical and frictional engagement of a typical pedal, said engagement sufficient to stabilize the pedal within the scaffold, i.e., against unintentional displacements by the player. The fixation elements include the fixation socket (FS) which engages a selected keyboard-base-tube position and the socket extension (SE) which rigidly connects between the FS and the PBC at an optimal angle and distance. Selected particular lengths and angular orientations of the SE elements are offered in several fixed alternative configurations for use with specific stand types. One exemplary embodiment offers a SE which provides adjustable length and angle.

Keyboard musicians who perform on electronic keyboards before large audiences in constantly changing venues are subject to continual substitution in the matter of placing their instrument, as well as the related amps and speakers. One particularly problematic consideration is the positioning of the foot-pedal controls for keyboard volume and other characteristics. Depending upon the frictional properties of the stage surface and playing style, i.e., whether the player is sitting or standing, the volume pedal (and other control pedals) are subject to accidental displacements in various directions in addition to possible overturning.

Therefore, before the beginning of a live concert, each player must develop practical methods to secure his control pedals at the optimal position for his convenient and certain access. Frequently, players utilize medical or industrial adhesive tape to secure the pedal base to various stage floor surfaces including glass, smooth ceramic tile and polished hardwood. While such temporary adhesive fixation can be done easily and quickly once the final position for the keyboard is defined, preliminary re-positioning may require multiple changes to accommodate for room acoustics, stage furniture and audio-system outlets. At best, this is an inefficient and unattractive methodology since the tape strips are highly visible to the audience and reflect a lack of "professional finish" on the part of the performer.

Itinerant keyboardists have long desired an attractive, compact, portable fixture which would mount one or more control pedals at a position ideally matched to their instrument stand, bench height and physique. This pedal position is typically unique for each player and depends upon their individual body proportions, especially the length of their lower legs and the size-mobility of their dominant foot, i.e., the foot used to actuate the volume pedal(s) in music segments which require extensive or intense pedal actuation. Indeed, even the choice of footwear to be worn during a performance may have an effect upon pedal footwork and the need for secure positioning. For example, the texture and frictional characteristics of the particular shoe sole against the foot-contact portions of the pedal(s) can be the critical factor in triggering accidental displacement. Even the player's footwear, i.e., type of heel and the angle of the sole against the pedal can have a significant effect on the balance of vertical and horizontal forces acting upon the pedal.

At this time, there is no commercial device offered which attaches to the base of typical popular pedals and provides an anchor to hold it in a fixed position relative to the player's active foot and the keyboard stand. It is therefore an object of the present invention to provide keyboardists with a device and method for optimal, ergonomic positioning of one or more foot controls during a performance.

BRIEF DESCRIPTION OF THE DRAWINGS

In FIG. 3(*a*) the right-hand rail is shown as a broken section to indicate the width of the bottom portion as being about the same as the sidewall height. The separator strip 52 is also shown in broken section to indicate its thickness, 52*t*, and its length comparable to that of the adjacent opposing members. FIG. 3(*b*) shows isometric views of an alternative separator strip, 72, which extends axially about 20-50 mm behind the back wall and provides a pivot hole. An alternative right-hand side rail, 71, is also shown in FIG. 3(*b*); this element is provided with a tab extension which extends in a transverse direction about 20-50 mm and includes a pivot hole 75. In FIG. 3(*c*) the separator strip, 52, is shown in an alternative grooved form which captures the linkages, (55) into the groove when the abutting extension 54 is attached to its upper surface.

DETAILED DESCRIPTION OF EMBODIMENTS

TABLE 1 is a list of indicia used to characterize features of the present invention. The value range and measurement units for each feature are listed along with the indicia for that particular feature. The right column shows the nominal, non-dimensional, length-scaling value for some selected dimensions relative to the LPB1 measurement. The initial design stage for the present invention was to analyze representative, quantitative OEM or independent research data on actuation-force and travel distance ranges of typical commercial pedals; however, none could be found. Worst-case pedal-tip parameters including shape, size, smoothness were estimated and used to model key parameters of the present invention, e.g., displacement forces and overturning torque to be resisted.

Special Terms. The foot-control scaffold of the present invention includes the following major elements: (a) a fitted pedal-base channel (PBC) and (b) a fixation socket (FS). Ullage elements may be attached to selected faces of the socket to provide elastic-frictional engagement with pedal base and to support the pedal at a player-preferred angle.

Figure 1:
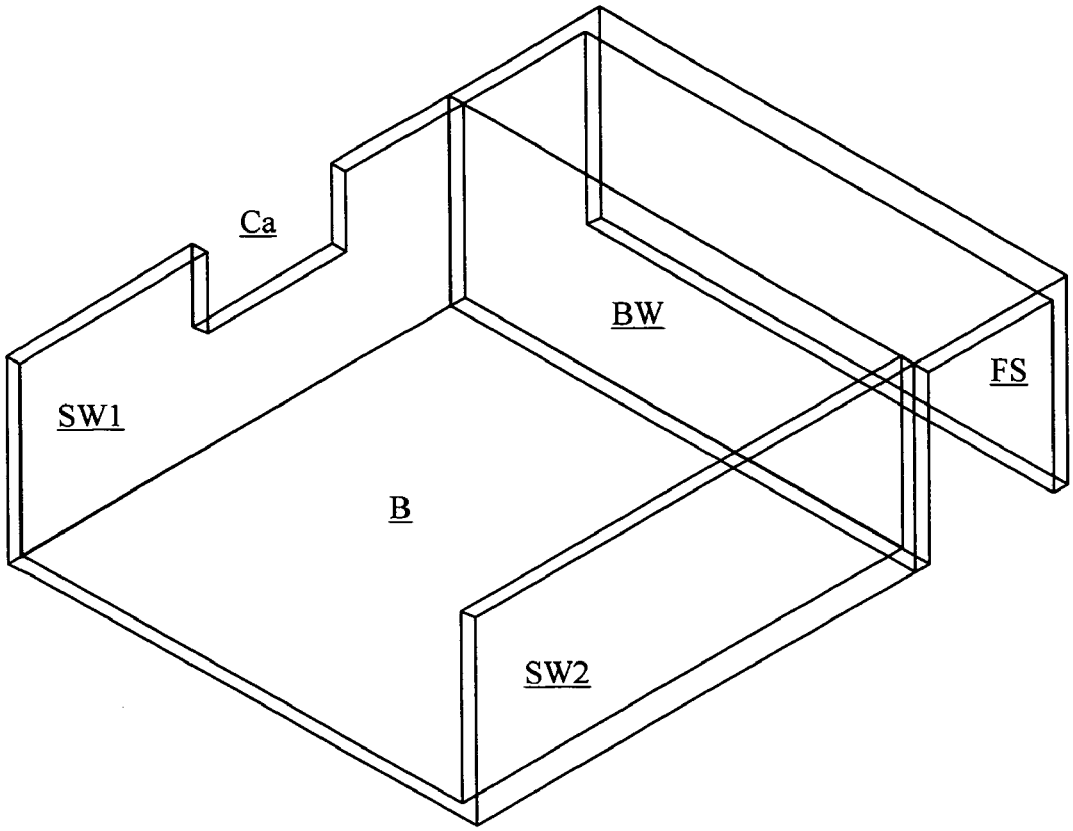
FIG. 1 is a isometric wire-frame view of a compact scaffold embodiment provided with a fixation socket molded integral with the back wall, i.e. the socket extension length, L22_cl, and the A4 angle are predetermined values. In this embodiment the back wall, BW, also forms one wall of the base-tube fixation socket, FS. This customized embodiment is scaled for a particular pedal length and base width and is used with a frame offering a suitably-oriented base tube immediately adjacent the range of desired pedal positions, i.e., no extension member nor angle adjustment is needed. It is anticipated that such embodiments prepared for a few combinations of major-brand stands and pedals will be popular.
Figure 2:
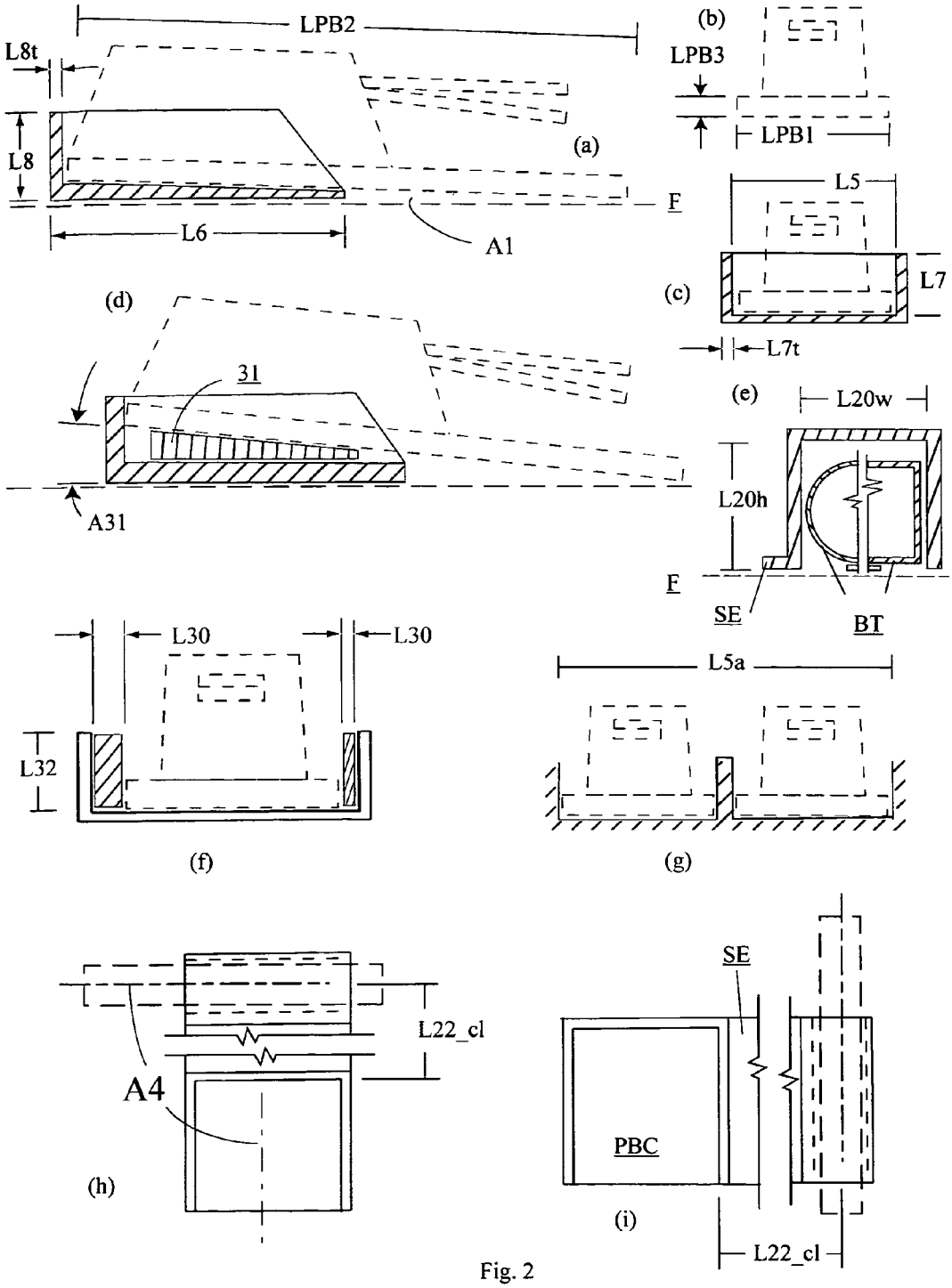
FIGS. 2(*a*) to 2(*i*) show illustrative top, front, side and sectional views of: several alternative embodiments of the scaffold, custom fitting to a typical pedal using ullage strips as well as the location, orientation and length of the socket-extension member and slip-over engagement of the fixation socket with an adjacent stand tube.

Fitted pedal-base channel, PBC. The channel is a U-shaped element open at one end to allow insertion of the base of a known pedal. The channel is shorter than the pedal base so that a distal portion of the pedal base is encompassed at full insertion. This element is formed by a bottom member and two opposing side walls. The side walls, which are closely fitted to the pedal-base width, LPB1, and provide lateral support to maintain the pedal base against tip-over or sliding. Typically the side-clearance gap between the pedal base and the scaffold side walls ranges from nil, i.e., light planar contact, to a few millimeters on each side. The channel side-fit tolerances are governed by the particular embodiment of the present scaffold including: (a) a pedal-customized width, (b) one or more fixed-width with compliant ullage strips and (c) a mechanically-adjustable width. As shown in FIG. 1 and FIGS. 2 (*a*)-(*c*), the channel may be made to a predetermined width for effective lateral pedal-base engagement without the use of ullage elements.

As shown in FIG. 2(*f*), the width and thickness of the ullage engagement elements are defined by L30 and L32 respectively; value ranges for these parameters are given in TABLE 1. The elastic properties of the various foamed or solid ullage elements fall in the range 0.05 to 1.0 times the room-temperature modulus value of the solid form of known materials, e.g., those listed in TABLE 2a. The active contact face of the ullage element, which engages the pedal base, may also be provided with a known surface texture, e.g., ribs, dots, etc., or known high-friction coating layer, e.g., soft latex, hook-loop, or grit particles.

For the customized- and fixed-width embodiments, the bottom, sides and back walls are combined into an integrated assembly by: known fasteners, bonding of separate individual components using known adhesives or by other known processes such as welding, brazing, soldering, etc., or formed integral by known methods including machining, molding, forging or casting. TABLE 3 lists some illustrative polymer types, along with their properties, which are useful to prepare components or assemblies of the present invention. Of course, known metals, alloys and ceramics are also useful for preparing components or assemblies of the present invention.

To prepare the adjustable-width embodiment, a fixed-width base channel configuration is divided lengthwise so that each resulting portion includes a complete sidewall, incorporated with a portion of the bottom and a portion of the back wall. These mating portions are connected by one or more known mechanical fasteners such as strips, rods, tubes, etc., extending perpendicular to the PBC centerline below the its surface which permit a width adjustment range up to about 2*LPB1 whereby one or two classic or industrial model pedals are accommodated with pedal-base gap tolerances in the range 0-2 mm.

For any of the embodiments disclosed above, the thickness of the bottom element may be either uniform or length graded including: (a) the bottom thickness is constant in the range of 2-6 mm or (b) the bottom is tapered along its length from thicker at the back to thinner at the front. Of course, the bottom and side wall components may be molded from thin sections, i.e., about 1-2 mm thickness, and provided with surface-texture patterns (0.1-0.5 mm height) facing the channel interior, e.g., oriented, high-friction ribs or a pattern of random-sized, raised features.

The extension, or height L7, of the back and side walls above the channel bottom, B, is variable between embodiments according to two user preferences including: (a) the particular pedal style and (b) the range of angular adjustment desired. For most players, the optimal value of L7 falls in the range 10-30 mm and this value is constant. For another embodiment, L7 is linearly graded, along the channel length, L6, i.e., about 40 mm at the back and dropping to about 15 mm at the front.

For certain fixed-width embodiments, the interior or pedal-contact faces of the side walls are provided with a layer of compressible ullage material such as synthetic elastomer or elastomer foam, which also offers a high coefficient of friction with the pedal-base surface and thus helps to prevent slippage of the pedal within the channel. The thickness of the compliant elements is chosen by the user to provide the optimum retention for his particular style of play; generally, the ullage materials are 0.2 to 10 mm thick and may be soft, closed-cell urethane foam or harder, e.g., 50 durometer (Shore A) textured natural gum-rubber strips or synthetic elastomer bands secured to the sidewall surface(s) by means of known adhesive or other known mechanical attachments. A wide range of elastomers is useful for preparing ullage components of the present invention, e.g., the exemplary types listed in TABLES 2a and 2b. Bottom and side wall ullage components may also be prepared with surface-texture patterns facing the channel interior, e.g., oriented, high-friction ribs or a pattern of random-sized, raised features.

At least one of the channel walls is provided with a slot opening, Ca, for drop-in passage of a pedal cable approximately 5 mm in diameter.

Fixation socket, FS. This element is a three-sided engagement clasp which removably and substantially rigidly couples the scaffold, along with the supported pedal, to an adjacent anchor point on the keyboard stand. Keyboard stands are typically made from round or polygonal metallic tubing, typically about 20-40 mm diameter or across the flats. The socket width, L20*w*, is prepared to be a close, or light interference, fit with the mating stand element outside dimension, i.e., L20*w* usually ranges from about LS3−1, mm to LS3+2, mm.

In one embodiment, shown in FIG. 1, the fixation socket is integrated into one wall of the pedal-base channel and is secured to a selected adjacent point on the keyboard support stand.

Generally, the fixation socket width, L20*w*, (see FIG. 2*e*) is slightly larger than the width of the base tube at the preferred anchor point to facilitate easy, drop-on engagement. However, alternative embodiments include L20*w* values slightly smaller than the base tube OD, i.e., 0.1 to 0.5 mm, whereby FS engagement requires a downward force of 0.1 to 10 N. Further, the inner surfaces of the socket are optionally formed with one or more low, rib-like texture features, i.e., 0.05 to 0.2 mm height, along the lower edges of the FC vertical faces. Finally, it is envisioned that various embodiments of the present invention will also be provided with known fastening devices to assure exact, positive fixation to the base tube; such devices include thumb screws, screw-type clamping bands and tethered transverse pins.

Socket Extension member, SE [see FIGS. 2(*h*) and 2(*i*)]. The offset distance from the nearest channel wall to the centerline of the stand-tube for the engaged socket is L22_cl. The extension offset orientation, L22*w*, is indicated in Table 1 as being perpendicular to a sidewall or backwall, SW or BW respectively, or in an oblique direction measured as the angle, A4, between the centerline of the base member and the centerline of the pedal base channel.

For certain stand configurations and player styles the distance between the scaffold and the anchor point is short enough to favor the compact linkage shown in FIG. 1. For other situations, the separation may be as much as 300 mm and the link form of FIG. 2(*h*) or 2(*i*) is favored. In the case of some V-base column stands, the base legs extend toward the player from the rear (like an open "V") at oblique angles and the link between the channel and the base tube may require a socket supported at an acute angle, A4, in the range 10-80 deg. and at a L22_cl distance of 20-250 mm.

The rigid connecting structure(s) between the channel portion and the socket portion may be any convenient form such as one or more thin-web (1-6 mm thick and about 25 mm wide) polymer strips molded integral. Alternatively, the extension member may be one or more known strips, bars, rods or tubes fastened securely by known technics to both the channel and socket components whereby the foot pedal is held at an optimal fixed location as defined by the player. For a typical player and stand, the ideal pedal positioning may depend upon a number of factors unique to the stage, event and the number of other performing musicians in the group.

FIG. 2(*a*) shows a side view of the scaffold with a fully-inserted typical foot-pedal. For clarity, the known pedal is shown with broken lines. The single moving element of the pedal is also shown in broken lines in its "up" and "fully-depressed" positions. The bottom and backwall are shown in a section cut by a vertical plane passing along the centerline of the channel [see FIG. 2(*h*)]. In this embodiment, the bottom thickness is shown as tapered (angle=A1) to about 1-2 mm at the front edge so that the distal pedal base rests firmly on the bottom and the pedal is tilted at a slight angle, e.g., A1 is about 1-5 deg. The local floor surface under the scaffold, which may be carpet, wood or other material, is denoted as F. The length of the pedal, LPB2, may also be used as a basis for scaling the channel length, L6, for improved engagement to the dimensions of specific control pedals.

FIG. 2(*b*) is a front view of a typical foot pedal showing the base width, LPB1, which is the basis for size scaling of the channel width.

FIG. 2(*c*) is a sectional view of the channel cut by a vertical plane parallel to the back wall passing through the length midpoint of the channel. This view allows easy visual comparison of the fit of LPB1, the pedal width and L5, the channel width.

FIG. 2(*d*) is a sectional view [similar to the section of FIG. 2(*a*)] showing a channel embodiment with a fixed-thickness bottom and an selected removable ullage tilt wedge, 31, which supports the pedal at a selected ergonomic angle, A31, for the particular player. One or more ullage wedges may be affixed to the channel bottom, B, by known means such as adhesive or threaded fasteners to provide a pedal tilt, A31, in the range 0.5 to 10 deg. Typically, ullage tilt wedges are formed from harder elastomers/foams than engagement elements, e.g., harder than 50 Shore A.

FIG. 2(*e*) is a sectional view cut by a plane perpendicular to the stand-tube axis showing engagement of the fixation socket, FS, on a typical square or round tube. The base tube, BT, diameter or distance across its flats, LS3, is the scaling basis for L20*w*, the opening-width of the fixation socket. To allow for the thickness of pads or feet attached to the floor-contact areas of the base tubes, the socket-opening depth, L20*h*, is at about 2-5 mm larger than the width.

FIG. 2(*f*) is a sectional view [similar to the section of FIG. 2(*c*)] of a fixed-width channel embodiment and the use of ullage strips for close fitup with the pedal base. In this illustrative embodiment each ullage strip is unique, i.e., different material hardness, coefficient of surface friction with the pedal base and strip thickness for SW1 re SW2. Surface texture patterns formed into the exposed faces of the ullage pads are an effective way to add additional stability. Ullage hardness is, of course, controlled by the density of the elastomer, i.e., whether it is solid or composed of closed- or open-cell foam, e.g., foam being the thicker, softer element.

FIG. 2(*g*) is a sectional view [similar to the section of FIG. 2(*c*)] showing a dual-channel embodiment for two pedal bases of similar size. For this embodiment the combined width of two pedals and a center separator is illustrated as L5*a*, which is in the range 140 to 200 mm.

FIG. 2(*h*) is a top view of the channel, the fixation socket and the back-wall extension member showing engagement with an adjacent stand tube. This illustrative custom embodiment shows attachment to a stand tube running perpendicular to the pedal base-channel axis, i.e., A4=90 deg. The full length of the extension member is variable according to the preferences of the player and the particular stand; it is envisioned, however, that such embodiments would be offered with: (a) a range of L22_cl extension values and (b) a range of A4 orientation angles, e.g., 0-45 deg.

FIG. 2(*i*) is similar to FIG. 2(*h*) and shows a customized embodiment which attaches to a stand tube running approximately parallel to the pedal-base channel. In this illustrative embodiment, A4 is 0 degrees; it is envisioned, however, that such embodiments would be offered with a range of L22_cl extension values and a range of A4 orientation angles, e.g., 0-45 deg.

Reliable anthropometric data for adults has been used to design the ergonomic pedal-tilt angles integrated within the present invention. An ideal ergonomic scaffold allows full pedal actuation with a 0-20 deg of ankle rotation in the same plane as the pedal travel. The present invention, which provides reliable ergonomic pedal positioning provides for pedal lateral-angle orientation and optimal pedal tilt. For a seated adult player with a calf length of 407 mm, a foot length of 266 mm and a foot breadth of 104 mm, the comfortable range of ankle motion is about 0-20 deg. This range is also generally applicable for young players; the most important factor is orienting the plane of pedal motion to coincide with the plane of comfortable ankle motion. For a player in either sitting or standing stance, typical OEM pedals should be tilted slightly toward the player to permit easy, controlled actuation; see angle A31 in FIG. 2(*d*).

EXAMPLES OF ALTERNATIVE EMBODIMENTS

Examples 1-4 illustrate alternative kit embodiments of the basic scaffold of the present invention, i.e., a customizable, pedal-base channel of adjustable width to assure reliable engagement with pedals of different lengths and widths. The kits include a set of main components with parameters as listed in TABLE 1, said components prepared from materials of appropriate mechanical properties including: metals, alloys, ceramics and polymers as listed in TABLES 2(a), 2(b) and 3. The kit components are formed according to designs illustrated in FIGS. 1,2 and 3 from which the user is able to assemble a reliable scaffold for pedal positioning, including optimized presentation angles: A1, A4 and A31. To facilitate rapid, correct assembly of a scaffold for pedals within a selected size range, the kits may be offered in several size versions, i.e., small, medium and large; each version being provided with a set of with scaled components adapted to fit defined size range as indicated in its description and external labeling. Each such kit is provided with a set of "user friendly" assembly instructions for the components on the contents list; said instructions include scaffold-maintenance hints as well as specifications of any alternative, supplemental, substitute or repair/replacement parts such as adhesives, ullage elements, fasteners and belleville washers.

Example 1

Figure 3:
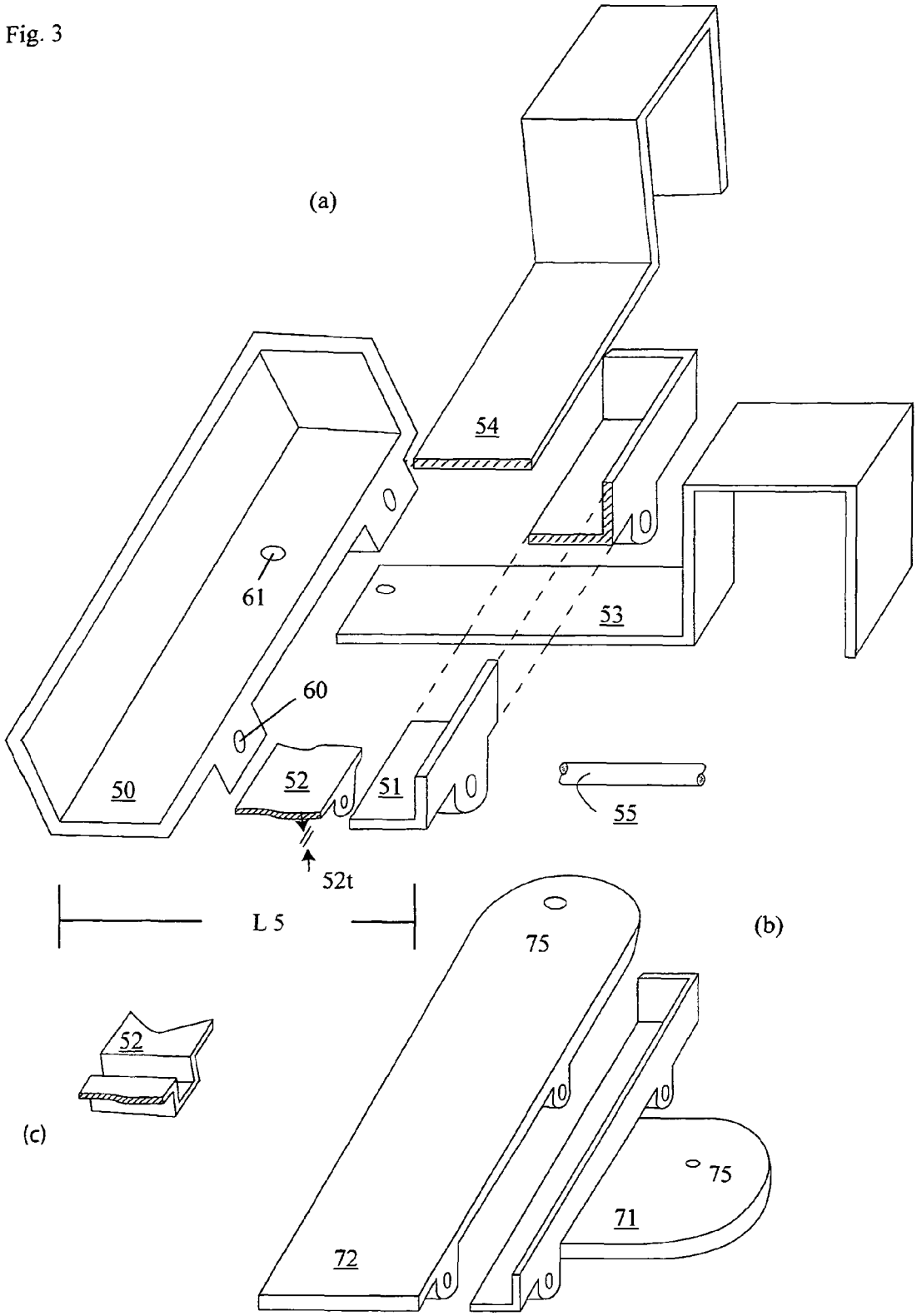
FIGS. 3(*a*), 3(*b*) and 3(*c*) show Example embodiments 1-4 in the isometric view; each of these embodiments is provided with opposing side rails connected on slideable links.

Scaffold kit with single adjustable-length axial SE element, 54, extending parallel to the channel centerline. FIG. 3(*a*) shows an illustrative embodiment with opposed side rails 50 and 51 connected by two transverse links long enough to accommodate one or two pedals held between the "L-shaped" side rails. For this illustrative embodiment, the links, 55, are shown as cylindrical rods; other known link shapes/sections such as tubes, channels and angles are also alternatives. The links extend slideably in passages, 60 formed across the width of the bottom portion of the side rails so that the axis of the links is perpendicular to the longitudinal centerline of the of the pedal channel. In this illustration, the link passages are shown as drilled or cored holes; alternative link forms and mating passage sections such as square, rectangle triangle, etc. could also be used. Known clamping devices, such as screws or clamps, are applied to fix the links to the side rails at a predetermined separation to hold the latter in a predetermined degree of engagement with the selected pedal base(s), LPB1.

The separator strip, 52, selected to be of appropriate narrower width than the SE element 54, is threaded onto the links between the side rails before they are brought into their pedal-engaged position. This separator strip provides a wide choice of alternative locations for known, user-placed thru fasteners, e.g., screws, bolts, pins, by which the axial socket extension, 54, is attached rigidly to the pedal channel. The thickness of the separator, 52*t*, is typically less than the thickness of the bottom portion of the side rails by an amount sufficient to place the upper surface of extension 54 to become approximately planar with the matching surface on the side rails. Optionally, an array of thru-fastener holes at predetermined positions is provided on the strip 52 and the extension 54 whereby the separation distance between the fixation socket and pedal channel is easily adjustable according to user insertion of known, mating thru fasteners.

As with other embodiments already described, the user may also apply ullage strips to the interior of the side rails to adjust the degree of engagement with the pedal base; further, a B-ullage wedge, 31, to adjust the pedal angle may also be applied.

Example 2

Scaffold kit with adjustable-length transverse SE element, 53, extending in the perpendicular to the channel centerline. The components of this illustrative embodiment are shown in FIG. 3(*a*). This version is generally similar to Example 1; however, it differs slightly in the placement and fixation of the transverse SE. In this version the extension member extends in a direction perpendicular to the axis of the pedal channel and it fits within floor-facing recesses of the side rails and generally between the transverse links. The separator strip and side rails provide a wide choice of alternative locations for known, user-placed thru fasteners, e.g., screws, bolts, pins, which connect the transverse socket extension, 53, rigidly to the pedal channel. Similar to Example 1, these elements may alternatively be provided with an array of pre-drilled holes for user insertion of thru fasteners whereby the separation distance from the keyboard base tube is fixed. As above, a variety of optional ullage elements are applied to optimize the degree of pedal engagement and its angle re the floor surface.

Example 3

Scaffold kit with adjustable SE-length and adjustable "pseudo-axial" SE orientation. The universal separator strip of this example, 72, is shown in FIG. 3(*b*); as can be seen, it also has a rear tab projection and as pivot hole 75. In this embodiment, the separator strip is threaded onto the links between the side rails before they are brought into their pedal-engaged position. The distal portion of this separator configuration is provided with an extension which projects axially beyond the back portion of the pedal channel and supports the pivot point, 75, for attachment of the socket extension, SE, by a known fastener.

Adjustment of SE orientation angle by approximately +/−45 degrees about the axial direction is accomplished by: (a) insertion of a known fixation washer between the separator surface and one of the pre-drilled holes at the end of the axial extension 54 and (b) tightening a known pivot bolt, e.g., M3 or M4, through all the components. Known angle-fixation washers include various types of serrated-edge or wave washers, e.g., DIN 6797, Schnorr safety washers and Bellville safety washers. The socket extension member, e.g., 53 or 54 may be secured below or above the pivot-extension tab of 72.

Adjustment of the distance between the pedal channel and the base tube is accomplished by cutting off excess length the standard SE element provided in the kit; this corresponds to adjustment of the L22_cl distance, which typically falls in the range 100 to 300 mm. The standard SE is provided with an array of a few pre-drilled pivot holes along its length; additional customization is also accomplished by user-drilled holes at locations dictated by the desired angle and length parameters.

As above, a variety of ullage elements are applied to the pedal-channel surfaces for optimization of the degree of pedal engagement and its angle re the floor surface.

Example 4

Scaffold kit with adjustable SE-length and adjustable "pseudo-transverse" SE orientation. As shown in FIG. 3(*b*), the right-hand side rail of this embodiment, 71, is provided with a transverse tab projection and a pivot hole 75; as described in Example 3 above, this pivot allows for angular adjustment of the socket extension about +/−45 degrees around the transverse direction.

TABLE 1

Scaffold Feature Indicia and Illustrative Design Parameters

| Indicia | Definition | Value min | Value typical | Value max | LPB1 Scaling Factor |
|---|---|---|---|---|---|
| | SITUATION-ENVIRONMENT CHARACTERISTICS | | | | |
| F | floor or floor-covering surface | | | | |
| LPB1 | pedal base width, mm | 70 | 80 | 116 | 1.000 |
| LPB2 | pedal base length, mm | 200 | 250 | ~300 | |
| LPB3 | pedal base height, mm | 10 | 20 | 50 | |
| LS3 | keyboard-stand base tube width, mm | 20 | 25 | 50 | |
| | SCAFFOLD PARAMETERS | | | | |
| PBC | Pedal-Base Channel | | | | |
| L5 | channel width, mm | 80 | 82 | 120 | 1.050 |
| L5a | dual-channel width, mm | 140 | 150 | 200 | |
| L6 | channel length, mm | 90 | 95 | 250 | 0.380 |
| SW1, SW2 | Channel Side Walls | | | | |
| L7 | sidewall height (SW1 or SW2), mm | 20 | 25 | 40 | |
| L7t | SW (thickness or range), mm | 1 | 3 | 10 | |
| BW | Channel Back (Distal) Wall | | | | |
| L8 | backwall (BW) height, mm | 20 | 25 | 40 | |
| L8t | BW (thickness or range), mm | 1 | 3 | 10 | |
| B | Channel Bottom | | | | |
| L9 | bottom (thickness or range), mm | 2 | 4 | 6 | 0.062 |
| Ca | Cable Opening | | | | |
| L10w | cable opening location, SW or BW | SW | oblique | BW | |
| L10 | opening size (width & depth), mm | 6 & 10 | 10 & 10 | 15 & 15 | |
| FS | Fixation- Socket | | | | |
| L20w | slot width, mm | 32 | 36 | 50 | 0.400 |
| L20h | slot height, mm | L20w | L20 | L20 | |
| SE | Socket Extension Member | | w + 2 | w + 5 | |
| L22w | CL-offset direction, (SW, BW or oblique) | SW | oblique | BW | |

TABLE 1-continued

| Scaffold Feature Indicia and Illustrative Design Parameters | | | | | |
|---|---|---|---|---|---|
| Indicia | Definition | Value min | typical | max | LPB1 Scaling Factor |
| L22_cl | channel interior offset distance, mm | 15 | 25 | 300 | 0.275 |
| A4 | acute angle, PBC cent_line to base tube, deg | 0 | (var) | 90 | |
| | PEDAL POSITIONING PARAMETERS | | | | |
| A1 | pedal-base and channel-bottom tilt, deg | 0 | ~1 | 5 | |
| L30 | SW, BW ullage strip thickness, mm | 0.5 | 1 | 25 | |
| 31 | B-ullage tilt wedge | | | | |
| A31 | B-ullage wedge angle, deg | 0.5 | 1 | 10 | |
| L32 | SW-, BW-ullage strip width, mm | ~10 | ~20 | ~40 | |

TABLE 2b

| Physical Properties of Selected Elastomers (a) | | | | | | |
|---|---|---|---|---|---|---|
| Elastomer (b) | Specific gravity | Hardness, Shore A | Tensile strength (c), MPa | Elong. (c), % | Resilience (d) | Compress. set (d) |
| NR | 0.93 | 30-100 | 27.6 | 750 | E | G |
| polyisoprene | 0.92 | 30-100 | 24.1 | 750 | E | F |
| SBR | 0.94 | 35-100 | 20.7 | 600 | G | G |
| butyl | 0.92 | 30-90 | 17.2 | 700 | P-F | P-F |
| polybutadiene | 0.91 | 45-80 | 17.2 | 500 | E | F |
| EPDM | 0.86 | 30-90 | 20.7 | 600 | G | G |
| chloroprene | 1.23 | 35-95 | 20.7 | 600 | G-E | F-G |
| nitrile | 1 | 30-100 | 20.7 | 600 | F-G | G |
| thiokol | 1.25-1.35 | 20-80 | 10.3 | 450 | P-F | P-F |
| urethane | 1.02-1.25 | 55-100 | 55.2 | 750 | F-E | G-E |
| silicone | 0.98-1.6 | 25-90 | 10.3 | 800 | F-G | G-E |
| CSM | 1.12-1.28 | 40-95 | 20.7 | 600 | F-G | F |
| acrylic | 1.09 | 40-90 | 13.8 | 400 | F-G | G |
| fluorocarbon | 1.85 | 55-95 | 20.7 | 450 | F | G-E |
| epichlorohydrin | 1.27-1.36 | 40-90 | 17.2 | 400 | F-G | F |
| chlorinated PE | 1.16-1.25 | 45-95 | 24.1 | 600 | F-G | F-G |
| cross-linked PE | 0.92 | 90+ | 20.7 | 500 | P | F |

(a) typical literature values
(b) NR = natural rubber; SBR = styrene-butadiene rubber; EPDM = ethylene-propylene-diene monomer; CSM = chlorosulfonated polyethylene; and PE = polyethylene.
(c) Maximum value at room temperature.
(d) E = excellent; G = good; F = fair, and P = poor.

TABLE 2a

| IUPAC Nomenclature for Selected Elastomers | |
|---|---|
| U | polyester urethane |
| BR | polybutadiene |
| BIIR | brominated isobutylene - isoprene (bromobutyl) |
| CIIR | chlorinated isobutylene - isoprene (chlorobutyl) |
| CPE | chlorinated polyethylene |
| CR | chloroprene rubber |
| CSM | chlorosulfonyl polyethylene |
| EAM | ethylene - vinyl acetate coplymer |
| EPDM | terpolymer of ethylene, propylene, and a diene w. residual unsaturated portion in the chain |
| EPM | ethylene - propylene copolymer |
| EU | polyether urethane |
| HNBR | hydrogenated acrylonitrile - butadiene rubber (highly saturated nitrile rubber) |
| IIR | isobutylene - isoprene rubber |
| IR | synthetic polyisoprene |
| NBR | acrylonitrile - butadiene rubber |
| SBR | styrene - butadiene rubber |
| E-SBR | emulsion styrene - butadiene rubber |
| S-SBR | solution styrene - butadiene rubber |
| X-NBR | carboxylated nitrile - butadiene rubber |
| X-SBR | carboxylated styrene - butadiene rubber |
| YSBR | block copolymers of styrene and butadiene |

TABLE 3

| Typical Polymer Properties, Molded Scaffold or Formed Elements | | | | | |
|---|---|---|---|---|---|
| Polymer Class | Specific Gravity | Tensile, kPa | Modulus, MPa | Elon-gation, % | Heat Dist. Temp, C |
| acetal | 1.42 | 65 | 2.79 | 44 | 117 |
| ABS | 1.04 | 45 | 2.24 | 100 | 101 |
| acrylic | 1.18 | 68 | 2.76 | 5 | 82 |
| PTFE | 2.16 | 28 | 0.52 | 240 | 56 |
| polyamide, 6/6 | 1.14 | 83 | 3.07 | 180 | 93 |
| polycarbonate | 1.2 | 62 | 2.38 | 85 | 137 |
| polyimide | 1.43 | 69 | 2.07 | 7 | 360 |
| polypropylene | 1.1 | 30 | 2.76 | 350 | 78 |
| polystyrene | 1.06 | 48 | 3.1 | 2 | 87 |
| polyurethane | 1.2 | 43 | 0.02 | 550 | 93 |
| PVC | 1.5 | 18 | 0.34 | 270 | 79 |
| polyphenylene oxide | 1.06 | 76 | 2.62 | 70 | 191 |
| polysulfone | 1.25 | 69 | 2.48 | 80 | 174 |

The invention claimed is:

1. A positionable scaffold for orienting and stabilizing a known foot-pedal control at an optimal ergonomic position, as determined by the player, for a keyboard musical instrument, the instrument being supported above the floor on a known stand, the stand having an array of floor-contacting members and the foot pedal having a generally rectangular base, the pedal base being further defined by a distal portion having a particular width, length, and height, the scaffold comprising:

(a) a channel adapted to support and stabilize the pedal base at an ergonomic orientation;

(b) said channel being defined by an axial centerline, a bottom, two side walls and a back wall;

(b1) said side walls being substantially parallel, each of a predetermined height and length and spaced apart a distance greater than said pedal base width;

(b2) said back wall being generally perpendicular to said side walls and extending therebetween; and (b3) said bottom being oriented generally perpendicular to said back wall and side walls and extending therebetween;

(c) said channel being further provided with a fixation socket having a slot adapted to engage an adjacent floor-contacting member of said instrument stand securely and removably;

whereby the foot-pedal control is ergonomically positioned and stabilized against creep displacements or tipping during playing of the instrument.

2. A scaffold according to claim 1 customized for a particular pedal-base width further comprising:

(a) said spacing of side walls of the channel being fixed by a integrated bottom member and scaled to provide a fit-tolerance-gap with the particular pedal-base width of about 0.2 to 1.0 mm;

(b) said fixation socket being attached to the channel with a minimal-length socket extension member to provide an offset distance from either back wall or side wall surface to the centerline of the floor-contact member of about 20 to 100 mm;

(c) at least one side wall being provided with an opening adapted to accommodate drop-in passage of an insulated cable up to approximately 5 mm in diameter extending from the pedal; and (d) the fixation socket slot width being sized to accept and mechanically engage a floor-contacting member of width in the range 15-40 mm;

whereby said foot pedal is ergonomically positioned and stabilized against creep displacements and tipping during playing of the instrument.

3. The scaffold of claim 2 further comprising:

(a) the fixation socket is further provided with at least one known, removable and adjustable mechanical-frictional clamping device engageable to clamp the socket and the floor-contacting member firmly together;

said clamping device being adjusted to secure the supported foot pedal against accidental tipping or displacement forces in the range of 1-20 N encountered under normal performance conditions.

4. The scaffold of claim 2 further comprising:

(a) said channel being formed integral by injection molding or by attaching individual components together; and (b) said channel or individual components being formed of one or more known polymeric materials including: acetal, ABS, acrylic, PTFE, polyamide, 6/6, polycarbonate, polyimide, polypropylene, polystyrene, polyurethane, PVC, polyphenylene oxide and polysulfone.

5. The scaffold of claim 1 for ergonomic positioning of two pedals, each having a particular base width, further comprising:

(a) said channel bottom being provided with a center separator of thickness and height similar to side walls which extends generally parallel to and between said side walls and which projects upward thereby defining two sub-channels for accommodation of the two pedal bases;

(b) said spacing of the side walls being increased to encompass the thickness of the center separator as well as the combined width of the two pedal bases;

whereby both said foot pedals are ergonomically positioned and stabilized against creep displacements and tipping during playing of the instrument.

6. The scaffold of claim 1 further comprising:

(a) the interior surface of each side wall being provided with a fixed, compliant ullage strip of a particular elasticity, surface texture and thickness;

(b) the side wall spacing being further adapted to assure elastic and frictional engagement between the pedal base and the ullage-elements sufficient to prevent accidental displacement;

(c) the bottom being provided with a fixed B-ullage wedge of sufficient length, thickness grading and elasticity to provide a customized tilt angle of the pedal base;

whereby the foot-pedal control is ergonomically positioned and stabilized against creep displacements or tipping during playing of the instrument.

7. The scaffold of claim 6 further comprising:

(a) said ullage elements and said fixed B-ullage tilt wedge being formed from one or more elastic materials including: natural rubber, polyisoprene, SBR, butyl, polybutadiene, EPDM, chloroprene, nitrile, thiokol, urethane, silicone, CSM, acrylic, fluorocarbon, epichlorohydrin, chlorinated PE and cross-linked PE.

8. The scaffold of claim 1 further comprising:

(a) the channel being provided with an extension member for the fixation socket which provides scaffold connection to the stand at selected angles and distances;

(a1) the extension member being adjustable in its angular orientation between pseudo-axial and pseudo-transverse to the axial centerline of the channel; and (a2) the extension member being adjustable in its length;

whereby the player is provided an extended range of pedal positioning options.

9. The scaffold of claim 6 further comprising:

(a) the channel being provided with an extension member for the fixation socket which provides scaffold connection to the stand at selected angles and distances;

(a1) the extension member being adjustable in its angular orientation between pseudo-axial and pseudo-transverse to the axial centerline of the channel; and (a2) the extension member being adjustable in its length;

whereby the player is provided an extended range of pedal positioning options.

10. The scaffold of claim 7 further comprising:

(a) the channel being provided with an extension member for the fixation socket which provides scaffold connection to the stand at selected angles and distances;

(a1) the extension member being adjustable in its angular orientation between pseudo-axial and pseudo-transverse to the axial centerline of the channel; and (a2) the extension member being adjustable in its length;

whereby the player is provided an extended range of pedal-positioning options.

11. A kit for assembling a customized, stabilized, ergonomic foot-pedal-scaffold to be used with a known musical keyboard supported on a specific known stand configuration such as V-form, T-form, X-form, Z-form and conventional table-type and controlled by one or more known commercial foot pedal models of particular base widths which, when used alone, are subject to accidental displacement and overturning in use comprising:

(a) a kit container labeled on its exterior to indicate the particular brands and models of foot pedals which are ergonomically positionable and stabilizable to which particular models of stands by assembling and applying the kit components contained therein;

(b) contents of said container including a set of matched scaffold components particularly adapted for use with the specific combinations of pedals and stands indicated on the label;

(b1) said set of components adapted for assembly of a customized scaffold having both axial and transverse socket-extension-member components;

(b2) said channel components configurable to provide specific side wall spacings sufficient to stabilize the specific pedal models indicated on the label;

(b3) said channel components being configurable to provide at least two player-selected pedal-base tilt angles in the range 0-5 deg.;

(c) contents including a set of matching known assembly parts and required fasteners; and (d) contents having a set of user instructions including a list of the components, directions for scaffold assembly, suggestions on use and guidance on adjustment and maintenance of the resulting customized, pedal-stabilizing scaffold.

12. A kit according to claim 11 wherein the scaffold components-set includes:

(a) only axial or transverse socket extension components; and (b) a specific set of attachable ullage elements and B-ullage tilt wedges configurable to provide multiple customized pedal-tilt angles in the range 5-40 deg for the label-indicated foot-pedal models;

(c) both such contents variations being described on the exterior label.

13. A kit according to claim 11 wherein the components-set includes:

(a) said scaffold components being formed from one or more known polymeric materials including: acetal, ABS, acrylic, PTFE, polyamide, 6/6, polycarbonate, polyimide, polypropylene, polystyrene, polyurethane, PVC, polyphenylene oxide and polysulfone;

(b) said ullage elements and said fixed B-ullage tilt wedges being formed from one or more materials including: natural rubber, polyisoprene, SBR, butyl, polybutadiene, EPDM, chloroprene, nitrile, thiokol, urethane, silicone, CSM, acrylic, fluorocarbon, epichlorohydrin, chlorinated PE and cross-linked PE.

* * * * *